US011779094B1

(12) United States Patent
Bickford et al.

(10) Patent No.: US 11,779,094 B1
(45) Date of Patent: Oct. 10, 2023

(54) REFILLABLE HAIR COLORATION PACKAGE AND APPLICATOR WITH ADJUSTABLE BRISTLES

(71) Applicant: L'Oreal, Paris (FR)

(72) Inventors: William Robert Bickford, Scotch Plains, NJ (US); Jason Fyfe, Holmdel, NJ (US); Andrea Saverino, Colts Neck, NJ (US); Oliver Sha, Fort Lee, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 17/829,100

(22) Filed: May 31, 2022

(51) Int. Cl.

| | |
|---|---|
| ***A45D 34/04*** | (2006.01) |
| ***A45D 40/26*** | (2006.01) |
| ***A46B 11/00*** | (2006.01) |
| ***A46B 7/04*** | (2006.01) |
| ***A46B 7/02*** | (2006.01) |
| ***A46B 17/04*** | (2006.01) |

(52) U.S. Cl.
CPC ..... *A45D 34/045* (2013.01); *A46B 7/023* (2013.01); *A46B 7/04* (2013.01); *A46B 11/0062* (2013.01); *A46B 11/0089* (2013.01); *A45D 40/265* (2013.01); *A46B 17/04* (2013.01); *A46B 2200/1046* (2013.01)

(58) Field of Classification Search
CPC ..... A45D 34/045; A45D 40/265; A46B 11/0062; A46B 7/04; A46B 7/023; A46B 11/0089; A46B 2200/1046; A46B 17/04
USPC ..... 401/183–186; 15/184, 169, 172, 190, 15/190.1, 201
See application file for complete search history.

(56) References Cited

U.S. PATENT DOCUMENTS

| | | | | |
|---|---|---|---|---|
| 2,698,452 A * | 1/1955 | Osrow | A46B 11/0041 222/107 |
| 4,331,247 A * | 5/1982 | Mumford | B65D 50/046 215/216 |
| 6,915,807 B2 | 7/2005 | Choi | |
| 9,364,068 B2 | 6/2016 | Kodama | |
| 10,368,630 B2 * | 8/2019 | Jones | A46B 9/10 |

(Continued)

FOREIGN PATENT DOCUMENTS

| | | |
|---|---|---|
| DE | 8208444 U1 | 6/1982 |
| JP | 4509510 B2 | 7/2010 |

(Continued)

OTHER PUBLICATIONS

French Search Report and Written Opinion, dated Jan. 19, 2023, issued in corresponding French Application No. 2208317, filed on Aug. 16, 2022, 6 pages.

*Primary Examiner* — David J Walczak
(74) *Attorney, Agent, or Firm* — Christensen O'Connor Johnson Kindness PLLC

(57) ABSTRACT

An adjustable applicator head with protrusion elements and a dispensing orifice in fluidic communication with a formulation reservoir operably coupled to a sliding length-adjustment element configured to adjust an exposed protrusion length of the protrusion elements along a direction parallel to a central axis of the length-adjustment element. The applicator can be refilled and re-used and is adjustable for different lengths of hair and hair styles. The tines or bristles can be replaced with foam applicators, sponges, or other surfaces for various applications, such as skincare, makeup or makeup removal.

15 Claims, 5 Drawing Sheets

(56) References Cited

U.S. PATENT DOCUMENTS

| | | | | |
|---|---|---|---|---|
| 2002/0181998 | A1 | 12/2002 | Petit | |
| 2003/0041869 | A1 | 3/2003 | Dovergne et al. | |
| 2005/0273962 | A1* | 12/2005 | Dillon | A46B 9/10 15/169 |
| 2008/0060665 | A1 | 3/2008 | Umeno et al. | |
| 2014/0331429 | A1* | 11/2014 | Lim | A45D 33/00 15/190 |

FOREIGN PATENT DOCUMENTS

| | | | |
|---|---|---|---|
| JP | 4721511 | B2 | 7/2011 |
| KR | 101315538 | B1 | 10/2013 |
| WO | 2019/114957 | A1 | 6/2019 |

* cited by examiner

REFILLABLE HAIR COLORATION PACKAGE AND APPLICATOR WITH ADJUSTABLE BRISTLES

SUMMARY

A refillable hair coloration package that has an applicator head that utilizes a sliding mechanism that is adjusted by the consumer to change the bristles or tine height to fit the task required. For example, the bristle height is adjustable to use with beard hair or scalp hair, and the like.

The adjustable hair coloration package can allow the user to: mix colors by shaking two or more ingredients (e.g. oil and water components, oxidizers/developers, dyes/tints, etc.) in the package before application; dispense formula cleanly and accurately to both the hair and the beard that is performed with a sliding applicator head that can be specifically positioned to accommodate different hair lengths and types (straight or curly for example); be able to be used, cleaned, and importantly refilled and reused. In one embodiment, the adjustable hair coloration package is refillable unlike a mono-dose package for permanent hair coloration like most conventional packages in this function.

The refillable hair coloration package may include a wide opening reservoir for filling one or more coloration formula components. The package seals and reseals for agitation and application. The large opening can be covered with a shipping cap or removable lidding (to cover a formula component for example) before first use.

In one embodiment, the adjustable applicator head is designed to be slid up or down linearly in parallel with the axis of the package in this configuration to create bristle or tine lengths that match the hair on the head or face for accurate, clean and precise dispersion. Applicator surfaces could include plastic tines, bristles or bristle clusters, non-woven materials, open celled materials such as foams, or other applicator materials common to the cosmetic industry.

In one embodiment, the reusable hair color package and applicator components could be composed of chemically resistant materials to hair colorant ingredients. Typically, these are olefins such as polypropylene and polyethylene, but glass and metal (ex. formed steel or aluminum cans with coating or anodization) could be used.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Disclosed is an adjustable applicator head with protrusion elements and dispensing orifice in fluidic communication with a formulation reservoir operably coupled to a sliding length-adjustment element configured to adjust an exposed protrusion length of the protrusion elements along a direction parallel to a central axis of the length-adjustment element. The applicator can be refilled and re-used and is adjustable for different lengths of hair and hair styles. The tines or bristles can be replaced with foam applicators, sponges, or other surfaces for various applications, such as skincare, makeup or makeup removal.

Figure 1:
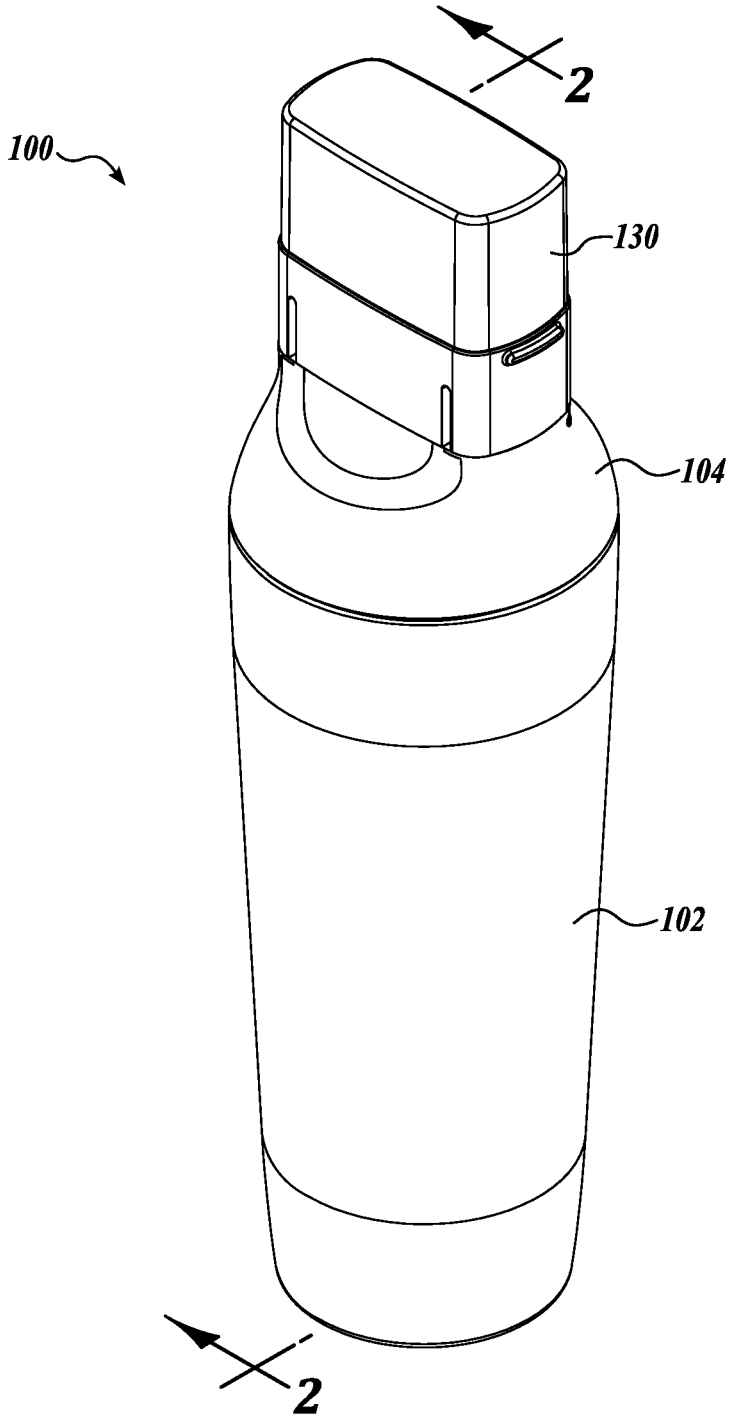
FIG. 1 is a diagrammatical illustration of a package according to one embodiment.
Figure 2:
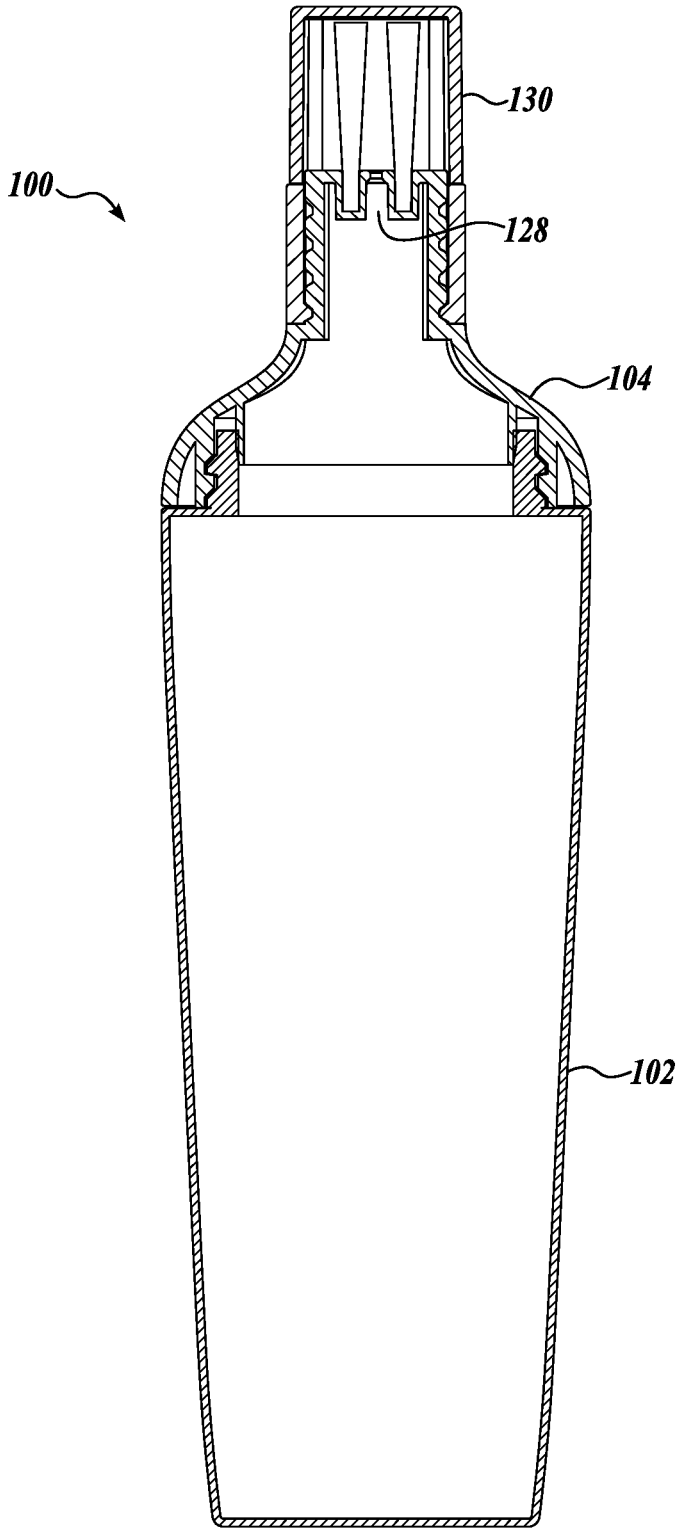
FIG. 2 is a diagrammatical illustration of a cross-section view of the package of FIG. 1.

FIG. 1 is a diagrammatical illustration of one embodiment of a refillable package 100 that can be used for hair coloration. FIG. 2 is a cross section illustration of the refillable package 100 of FIG. 1. The embodiment of the FIGURES illustrates bristles. However, the refillable package 100 can be used for various applications, such as skincare, makeup application, or makeup removal, with replacement of the tines or bristles with foam applicators or sponges.

The refillable package 100 includes a formulation reservoir 102 or bottle to hold the hair color or other formulation. The reservoir 102 is connected to an applicator 104, which is itself comprised of several parts. In one embodiment, the applicator 104 and reservoir 102 are connected through an interface that allows the applicator 104 to be removed to re-fill the reservoir 102. In one embodiment, the applicator 104 and reservoir 102 are connected to each other via screw-threads. A cover 130 can be placed over the applicator 104 to protect the applicator bristles and prevent the formulation from evaporation and drying out. The cover 130 can attach to the applicator 104 to be easily removed, such a through a snap fit.

The applicator 104 includes a cap 108, a bristle insert 112 having bristles 106, the bristle insert 112 is fixed in place at the top of the cap 108, and a linear sliding mechanism 110 that slides up on the bristle insert 112 to reduce an effective height of the bristles 106. In one embodiment, the cap 108 and bristle insert 112 are formed of a unitary piece of material, i.e., the bristle insert 112 is not removable from the cap 108.

Figure 3A:
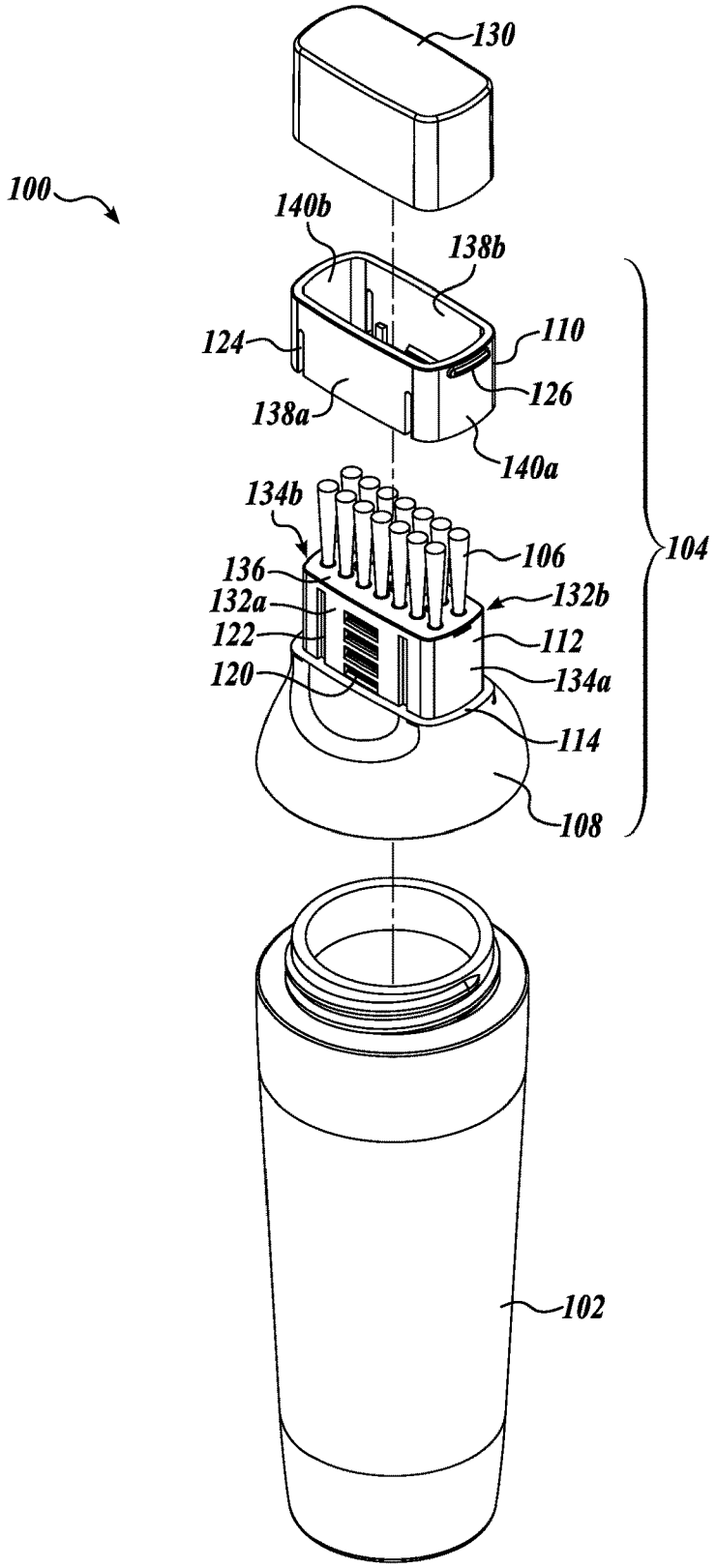
FIG. 3A is a diagrammatical illustration of an exploded view of the package of FIG. 1.
Figure 3B:
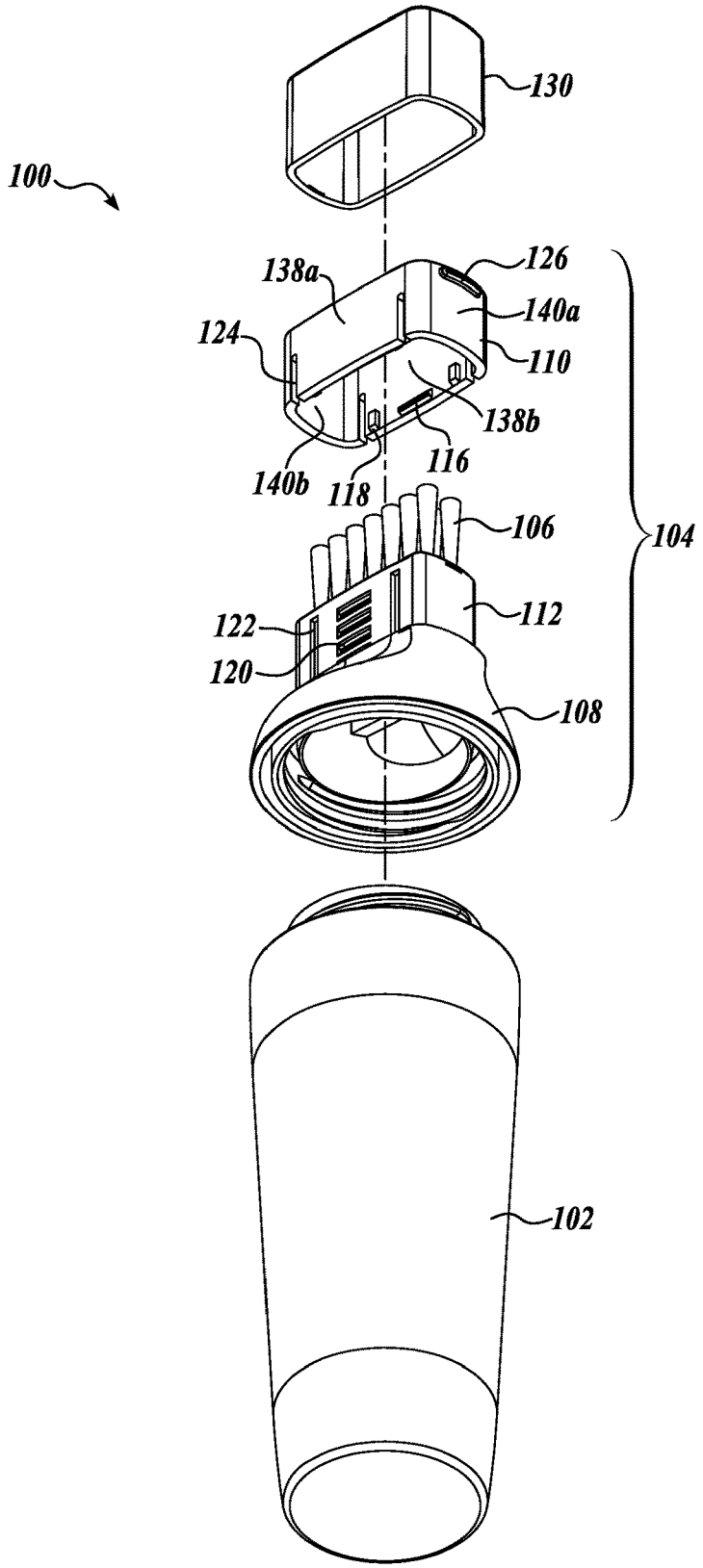
FIG. 3B is a diagrammatical illustration of an exploded view of the package of FIG. 1.

Referring to FIGS. 3A and 3B, in one embodiment, the cap 108 is formed from a dome-shaped bottom that transitions into a generally upward extending box-shaped structure on top that holds the bristles 106 in two rows, for example. The box-shaped structure can be called the bristle insert 112 and is comprised of a pair of opposite upstanding walls 132*a* and 132*b*, placed along a long dimension of the bristle insert 112. The bristle insert 112 is comprised of a second pair of opposite walls 134*a* and 134*b* placed along a short dimension of the bristle insert 112. The height of the four walls 132*a,b* and 134*a,b* comprising the bristle insert 112 can all be the same height to present an even surface on top. A horizontal surface 136 is on the top of the bristle insert 112 attached to the tops of the walls 132*a,b* and 134*a,b*. The horizontal surface 136 is used to hold the bristles 106. The horizontal surface 136 can include one or more orifices 128, as seen in FIG. 2. The orifices 128 allow the formulation to be dispersed onto the bristles 106. A shelf or narrow horizontal surface 114 can be formed at the transition at the top of the dome shaped bottom and the bristle insert 112 that surrounds the bristle insert 112 entirely around its periphery.

The bristle insert 112 is open on the bottom to allow the hair color or other formulation to travel through the bristle insert 112 and exit the bristle insert 112 through the top through one or more orifices 128 to be deposited on the bristles 106. Once applied, the formulation can be spread or applied via the bristles 106. In one embodiment, the bristles 106 can be attached to the bristle insert 112 in a manner that allows the hair color or other formulation to be transferred from inside of the reservoir directly to the bristles 106, such as through capillary action. Alternatively, the reservoir 102 can be a squeeze bottle wherein a squeezing action can force the hair color through the orifices 128 onto the bristles. In one embodiment, the reservoir 102 can include a dip tube that has one end extending to the bottom of the reservoir 102 and the opposite end is connected to the orifices 128 to allow dispersing formulation with the package in an upright position. A squeezing action applied to the reservoir 102 will force the hair color out through the orifices 128, or alternatively through a dip tube then through the orifices 128 onto the bristles 106.

Referring to FIGS. 3A and 3B, the linear sliding mechanism 110 is substantially similarly shaped to the bristle insert 112. The linear sliding mechanism 110 has a pair of opposite walls 138*a* and 138*b* placed in the long dimension and a pair of opposite walls 140*a* and 140*b* placed in the short dimension. The pair of long-dimensioned walls 138*a,b* and the pair of short-dimensioned walls 140*a,b* are only slight larger dimensioned than the bristle insert 112, so that the linear sliding mechanism 110 fits snugly on the bristle insert 112. The height of the four walls 138*a,b* and 140*a,b* comprising the linear sliding mechanism 110 can all be the same height to present an even surface on top and bottom. The linear sliding mechanism 110 is further open on top and bottom to allow the linear sliding mechanism to slide up and down on the bristle insert 112.

Figure 4B:
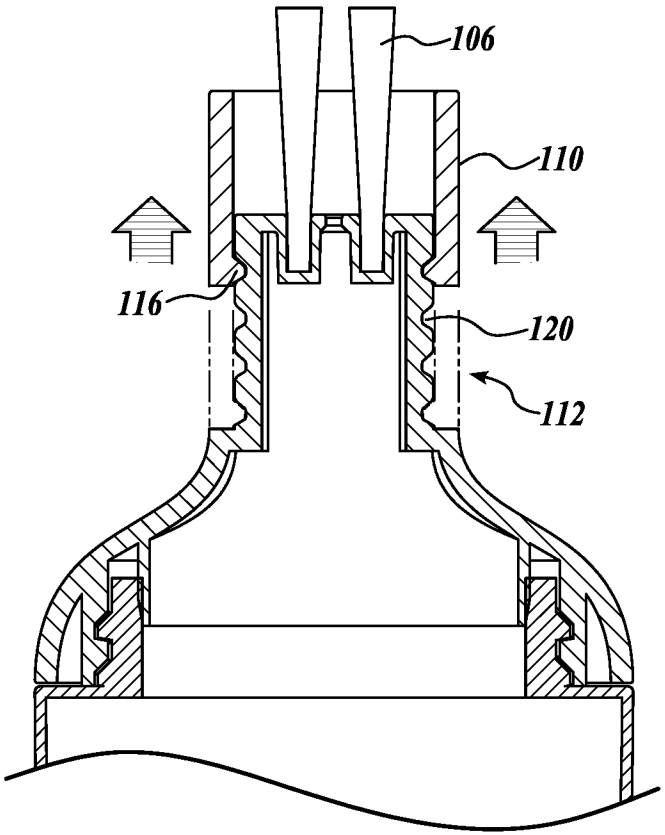
FIG. 4B is a diagrammatical illustration of an applicator with a linear sliding mechanism.
Figure 4A:
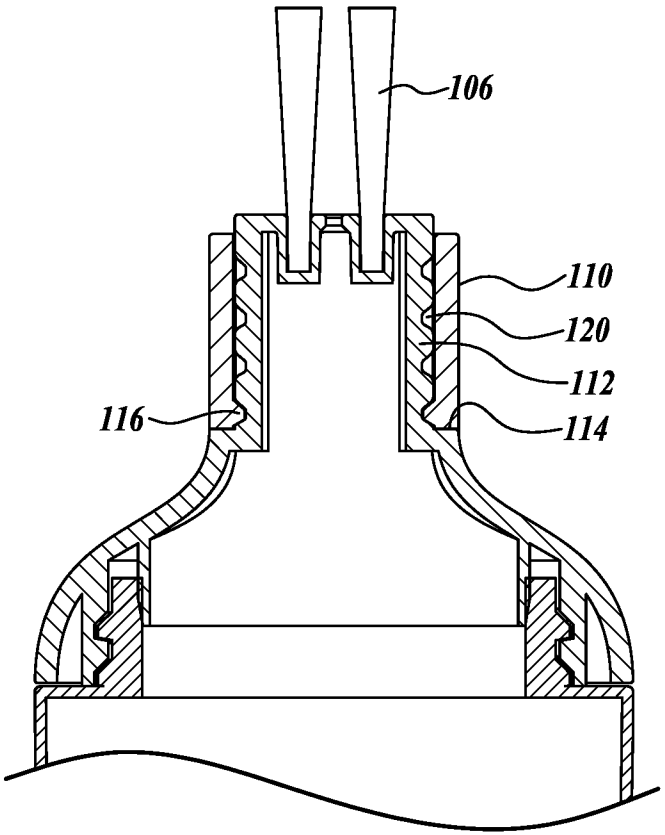
FIG. 4A is a diagrammatical illustration of an applicator with a linear sliding mechanism.

As illustrated in FIGS. 4A and 4B, the linear sliding mechanism 110 can be slid up and down on the bristle insert 112. Here, "linear" is used with "sliding mechanism" to mean movement in the up and down direction with respect to the center axis of the bristle insert. In one embodiment, the bottom edge of the linear sliding mechanism 110 is resting against the horizontal surface 114. In this position, the full lengths of the bristles 106 are fully exposed and the linear sliding mechanism 110 does not block access to the bristles 106. As seen in FIG. 4B, the linear sliding mechanism 110 can be slid up on the bristle insert 112 thereby the top edge of the linear sliding mechanism 110 is blocking access to the full length of the bristles 106 and reducing the effective height of the bristles 106. In FIG. 4B, the effective height of the bristles 106 can be defined as the distance from the top edge of the linear sliding mechanism 110 to the top ends of the bristles 106. As can be appreciated, the point of attachment of the bristles 106 to the bristle insert 112 remains fixed, while the exposed height of the bristles 106 above the linear sliding mechanism 110 can be adjusted.

The linear sliding mechanism 110 can slid up in predetermined increments or in a continuous manner. As can be seen, the bristle insert 112 remains fixed in place on the cap 108 and reservoir 102, and does not move. However, the linear sliding mechanism 110 is moved relative to the bristle insert 112 thereby effectively reducing the height of the bristles 106. An interface between the linear sliding mechanism 110 with the bristle insert 112 provides resistance to sliding and can include predetermined height settings of the effective height of the bristles 106.

In one embodiment of the interface, the linear sliding mechanism 110 has a horizontal linear detent 116 or bump on the inner facing surface of one or both of the walls 138*a*, 138*b* in the long dimension. In one embodiment, the detent 116 is placed adjacent to the inner facing surface of the long-dimensioned walls adjacent to the bottom edge of the walls 138*a*, 138*b*. The length or size of the detent 116 is designed so as to create a resistance to sliding the linear sliding mechanism 110. The resistance prevents the linear sliding mechanism 110 from accidentally being moved out of position during normal use, but still allows the user to slide the linear sliding mechanism 110 without having to exert excessive force.

As shown in the FIGS. 4A and 4B, the detent or detents 116 engage with an array of horizontal linear slots or grooves 120 on the exterior of the long-dimensioned walls 132*a,b* of the bristle insert 112 wherein such grooves 120 correspond to the size of the detent 116. The detent 116 engages each one of the grooves 120 one at a time as the linear sliding mechanism 110 is slid up and down on the bristle insert 112. In embodiments, the illustrated detent 116 can be replaced with an array of bumps, dimples, ribs, etc. placed on either of the linear sliding mechanism 110 or on the bristle insert 112, and the inverse of these features are formed on the respective opposite feature. The detent or equivalent structure is used to give a haptic feedback to the user when sliding the linear sliding mechanism 110. This feedback resembles a "click" and a visual printed or embossed/debossed numbers can be used to indicate the position or effective height of the bristles (for example, predetermined height settings of 1 mm, 3 mm, 5 mm) provide for an ideal length to meet the specific hair application.

As shown in the FIGS. 3A and 3B, the long-dimensioned walls 138*a,b* of the linear sliding mechanism can also include a pair slots 124 adjacent to each of the corners with the short-dimensioned walls 140*a,b*. The slots 124 are placed on the left and right of the detent 116 allowing the portion of wall with the detent 116 to be deflected outwards as the linear sliding mechanism 110 is slid up and down. The height of the slots 124 as well as the size of the detent 116 can be used to determine the resistance to sliding the linear sliding mechanism 110 from one position to another position.

In one embodiment, the linear sliding mechanism 110 can also include a pair of dogs or followers 118, also generally bumps, on inner surfaces of one or both of the long-dimensioned walls 138*a,b*. The followers 118 are also placed adjacent to the bottom edge of the walls 138*a,b*. Each of the followers 118 engages with a respective vertical slot 122 on the exterior of the long-dimensioned walls of the bristle insert 112, wherein such slots 122 correspond to the size of the followers 118. The slots 122 can terminate before the top edge of the bristle insert 112 providing a rigid stop to prevent the linear sliding mechanism 110 to be pulled off from the bristle insert 112 completely.

In one embodiment, the linear sliding mechanism 110 includes a handle 126 on each of the short-dimensioned walls 140*a,b* for a surer grip when sliding the linear mechanism 110 up or down.

The applicator 104 is open to the formulation reservoir 102 so that the hair color or other composition can flow from the reservoir 102 into the applicator 104. The applicator 104 is connected to the reservoir 102 in a manner that allows removing the applicator 104 from the reservoir 102. In one embodiment, the applicator 104 and reservoir 102 both include threads to allow the applicator 104 to be threaded onto the top of the reservoir 102. Removal of the applicator 104 allows the reservoir 104 to be refilled. Alternatively, different formulations can be provided in different reservoirs, and the applicator 104 can be connected to any one of a multitude of reservoirs.

In one embodiment, the thread on the cap 108 has a stopping/orienting bump feature that engages with the reservoir 102 to "lock" the applicator 104 in place to the reservoir 102 to ensure that the reservoir 102 is not accidentally opened when the package is being twisted during adjustment. This bump is disengaged when the consumer cleans out, refills and therefore reuses the package.

In one embodiment, the applicator 104 includes tines or bristles 106 at the top of the applicator 104. However, the tines or bristles 106 can be replaced with foam applicators, sponges, or other surfaces for various applications, such as skincare, makeup, or makeup removal.

The refillable package 100 allows the user to practice a method of applying a color formulation to hair, beard, moustache, and the like, in which the bristle height can be adjusted for the particular application. The method includes removing the cap 108 from the reservoir 102. The method includes filling the reservoir 102 with a hair color formulation. The method includes sliding a linear sliding mechanism 110 in an axial direction with respect to the cap 108 to change an effective height of bristles 106 attached to the cap 108. The method includes applying the hair color formulation with the bristles 106 that have an effective height less than the full height of the bristles 106.

A method of changing an effective height of bristles 106 on an applicator 104 is also disclosed. The method comprises sliding a linear sliding mechanism 110 to change an effective height of bristles 106 of an applicator 104 while the bristles remain fixed to the applicator 104. The method can further comprise moving the sliding mechanism 110 to one of a multitude of predetermined bristle effective height settings.

While illustrative embodiments have been illustrated and described, it will be appreciated that various changes can be made therein without departing from the spirit and scope of the invention.

The embodiments of the invention in which an exclusive property of privilege is claimed are defined as follows:

1. A refillable package, comprising:

a reservoir;

an applicator, the applicator including:

a cap that is attached to the reservoir;

a bristle insert having bristles, the bristle insert is fixed to a top of the cap; and a linear sliding mechanism that slides up on the bristle insert to reduce an effective height of the bristles, wherein the bristle insert includes an array of grooves, and the linear sliding mechanism includes a detent that engages with the array of grooves on the bristle insert, wherein the bristle insert includes a pair of opposite upstanding walls in a long dimension, and the linear sliding mechanism includes a pair of opposite upstanding walls in a long dimension, wherein a pair of followers is provided on an interior surface of one of the upstanding walls in the long dimension of the linear sliding mechanism and a pair of vertical slots is provided on an exterior surface of one of the upstanding walls in the long dimension of the bristle insert, the followers being engaged in the vertical slots and slidable along the vertical slots to guide the linear sliding mechanism along the bristle insert.

2. The refillable package of claim 1, wherein an interface of the linear sliding mechanism with the bristle insert provides predetermined settings of the effective height of the bristles and a resistance to sliding from one predetermined setting to another.

3. The refillable package of claim 2, wherein the predetermined settings of the effective height of the bristles are set 2 mm apart.

4. The refillable package of claim 1, wherein the linear sliding mechanism includes a slot to the left and right of the detent to allow a portion of a wall to be deflected outward.

5. The refillable package of claim 1, including a hair color formulation in the reservoir.

6. The refillable package of claim 1, wherein the bristle insert includes a pair of upstanding walls in a short dimension, and the linear sliding mechanism includes a pair of upstanding walls in a short dimension.

7. The refillable package of claim 6, wherein the cap further comprises a dome-shape at a bottom, wherein a transition from the dome shape to the bristle insert includes a horizontal surface surrounding the bristle insert.

8. An applicator, comprising:

a cap for attaching to a reservoir;

a bristle insert having bristles, the bristle insert is fixed to a top of the cap; and a linear sliding mechanism that slides up on the bristle insert to reduce an effective height of the bristles, wherein the bristle insert includes an array of grooves, and the linear sliding mechanism includes a detent that engages with the array of grooves on the bristle insert, wherein the bristle insert includes a pair of opposite upstanding walls in a long dimension, and the linear sliding mechanism includes a pair of opposite upstanding walls in a long dimension, wherein a pair of followers is provided on an interior surface of one of the upstanding walls in the long dimension of the linear sliding mechanism and a pair of vertical slots is provided on an exterior surface of one of the upstanding walls in the long dimension of the bristle insert, the followers being engaged in the vertical slots and slidable along the vertical slots to guide the linear sliding mechanism along the bristle insert.

9. The applicator of claim 8, wherein an interface of the linear sliding mechanism with the bristle insert provides predetermined settings of the effective height of the bristles and a resistance to sliding from one predetermined setting to another.

10. The applicator of claim 9, wherein the predetermined settings of the effective height of the bristles are set 2 mm apart.

11. The applicator of claim 8, wherein the linear sliding mechanism includes a slot to the left and right of the detent to allow a portion of a wall to be deflected outward.

12. The applicator of claim 8, wherein the bristle insert includes a pair of upstanding walls in a short dimension, and the linear sliding mechanism includes a pair of upstanding walls in a short dimension.

13. The applicator of claim 12, wherein the cap further comprises a dome-shape at a bottom, wherein a transition from the dome shape to the bristle insert includes a horizontal surface surrounding the bristle insert.

14. A method of applying a hair color formulation, comprising:

sliding the linear sliding mechanism to change the effective height of the bristles of an applicator of claim 8 while the bristles remain fixed to the applicator; and applying the hair color formulation with the bristles having the effective height less than a full height of the bristles.

15. The method of claim 14, comprising moving the sliding mechanism to one of a multitude of predetermined bristle effective height settings.

* * * * *